United States Patent [19]

Chambon

[11] 3,955,065

[45] May 4, 1976

[54] HAND HELD ELECTRIC HAIR-DRYER

[75] Inventor: Rene Chambon, Odos, France

[73] Assignee: S E B S.A., Selongey, France

[22] Filed: Sept. 9, 1974

[21] Appl. No.: 503,937

[30] Foreign Application Priority Data

Sept. 11, 1973 France ..... 73.32631

[52] U.S. Cl. ..... 219/371; 34/97; 34/243 R; 165/122; 219/367; 219/368; 417/411

[51] Int. Cl.[2] ..... H05B 1/00; F24H 3/04; A45D 20/10

[58] Field of Search .....219/366-377, 219/379-382, 359-365; 34/96-101, 343 R; 128/256, 257; 417/411; 165/122

[56] References Cited

UNITED STATES PATENTS

| | | | |
|---|---|---|---|
| 1,750,094 | 3/1930 | Emmrich | 165/122 |
| 1,809,458 | 6/1931 | Wahl | 219/366 X |
| 2,267,547 | 12/1941 | Zimmerman | 128/256 |
| 2,473,325 | 6/1949 | Aufiero | 219/375 X |
| 2,509,137 | 5/1950 | Denman | 219/370 UX |
| 2,678,376 | 5/1954 | Lockwood | 219/370 |
| 3,058,233 | 10/1962 | Guhl | 34/99 |
| 3,818,600 | 6/1974 | Fischer | 34/97 X |

FOREIGN PATENTS OR APPLICATIONS

| | | | |
|---|---|---|---|
| 193,181 | 12/1937 | Switzerland | 34/99 |
| 22,646 | 1/1962 | Germany | 219/371 |
| 730,787 | 6/1955 | United Kingdom | 219/366 |
| 1,064,566 | 12/1953 | France | 34/99 |
| 662,078 | 7/1938 | Germany | 219/370 |
| 733,438 | 7/1932 | France | 34/99 |

*Primary Examiner*—A. Bartis
*Attorney, Agent, or Firm*—Young & Thompson

[57] ABSTRACT

A hand-held hair-dryer comprises a substantially spherical casing containing an electric heating element associated with an impeller driven by an electric motor. The casing comprises first and second hemispherical caps joined together to form a spherical body with at least one our admission opening between the joined edges of the caps. The impeller is arranged for air to be drawn into the casing through the air admission opening, to then pass into contact with the heating element and finally to pass through the impeller for discharge through a radially directed air-ejection nozzle carried by one of the caps. The dimesions of the spherical casing are such that the hair-dryer can be grasped in the palm of the hand.

7 Claims, 4 Drawing Figures

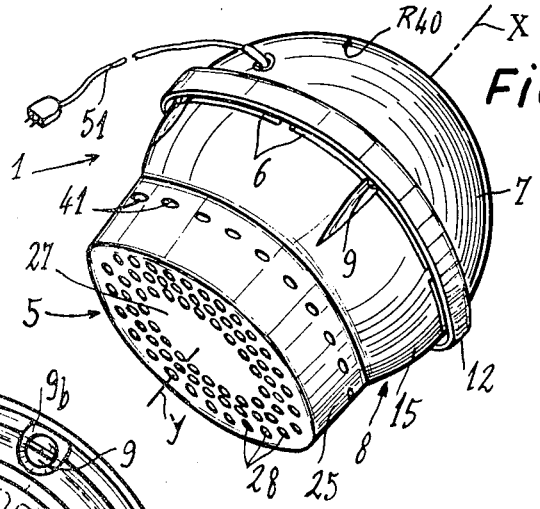
FIG. 1
FIG. 2
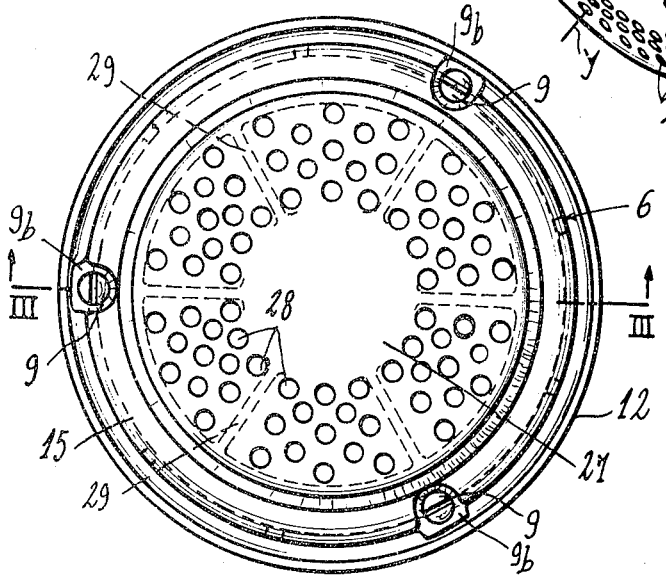
FIG. 4
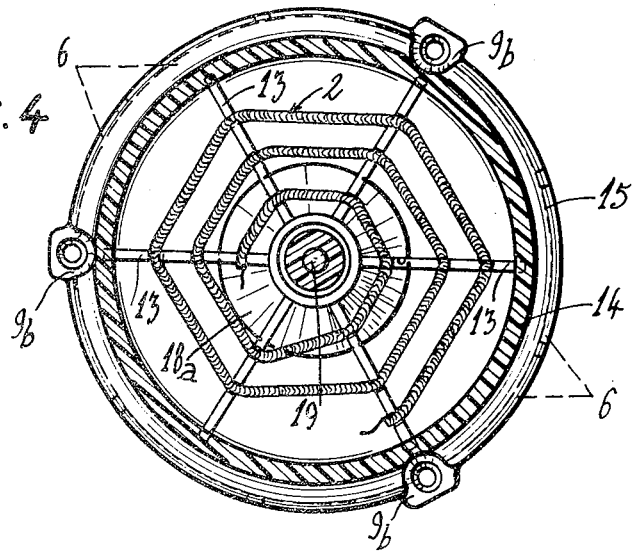

HAND HELD ELECTRIC HAIR-DRYER

This invention relates to a hand-operated electric hair-dryer.

There are many known forms of construction of hand dryers for the hair but these appliances usually consist of a body containing an air-impeller driven by an electric motor. The air ejected by the impeller passes through an electric heating resistance element which is also contained in the dryer body; an air-ejection nozzle which is rigidly fixed to or integral with the body initiates the formation of a stream of hot air which can be directed by means of a handle secured to the body.

When the user wishes to apply the hand dryer to his or her own hair, the appliance described above is often awkward and inconvenient to handle, especially when the stream of hot air has to be directed towards the hair at the back of the user's head. Furthermore, this appliance is fairly cumbersome and this last-mentioned drawback affects not only the use of the appliance but also its manufacture and commercial distribution.

One of the aims of the invention is to permit the construction of a hair-dryer which is convenient to handle, is of compact design and overcomes the disadvantages mentioned in the foregoing.

In accordance with the invention, the hand-operated electric hair-dryer comprising a casing which contains a resistance-type heating element associated with an impeller driven by an electric motor, the dimensions of the substantially spherical casing being chosen so as to facilitate holding with one hand and said casing being adapted to carry an air-ejection nozzle directed radially with respect to the casing, is characterized in that the motor, the heating element and the impeller are disposed in that order along the axis of the nozzle, the impeller being placed in the immediate vicinity of the nozzle.

By virtue of this design in which the volume of the casing is substantially defined by the volume of a hand in which it is held, the invention permits the most effective positional arrangement of the hair-dryer components and achieves highly efficient operation.

In one advantageous embodiment of the invention, the heating element is disposed on a surface which is substantially of revolution about the axis of the body defined by the air-ejection nozzle; the heating element is secured to the body by means of supports disposed radially with respect to the axis of revolution aforesaid.

This arrangement of the heating element is particularly favorable to a compact and economic design of the hair-dryer.

In a preferred embodiment of the invention, the hair-dryer body has a series of air-admission openings and a projecting portion for protecting said openings and constituting a beading which is substantially equatorial with respect to the axis of the air-ejection nozzle; the axis of rotation of the impeller coincides with the axis of symmetry of the heating element; the impeller is provided on the side opposite to the ejection nozzle with an upstream cheek which is substantially parallel to the surface of the heating element and placed opposite to this latter; said upstream cheek is provided with a suction opening in that portion which is adjacent to the impeller shaft; the impeller is provided on the side nearest the ejection nozzle with a downstream cheek which is open at its periphery for the ejection of hot air; said downstream cheek is provided in the central portion thereof with a solid disc centered on the axis of the impeller shaft; the air-ejection nozzle of substantially circular cross-section has peripheral openings for the discharge of hot air and a solid central portion corresponding respectively to the open portion and to the central disc of the downstream impeller cheek.

The effectiveness and convenience of construction and use of the hair-dryer in accordance with the invention are accordingly improved.

Further properties and advantages of the invention will become apparent from the following description of a preferred embodiment which is given hereinafter by way of example without any limitation being implied, reference being made to the accompanying drawings, wherein:

FIG. 1 is a view in perspective showing a hair-dryer in accordance with the invention;

FIG. 2 illustrates the hair-dryer of FIG. 1, looking on the ejection-nozzle end;

FIG. 4 is a diagrammatic transverse sectional view of the hair-dryer of FIG. 1, this view being taken along line IV—IV of FIG. 3 and assuming that the hemispherical cap has been removed from the bottom portion.

Figure 3:
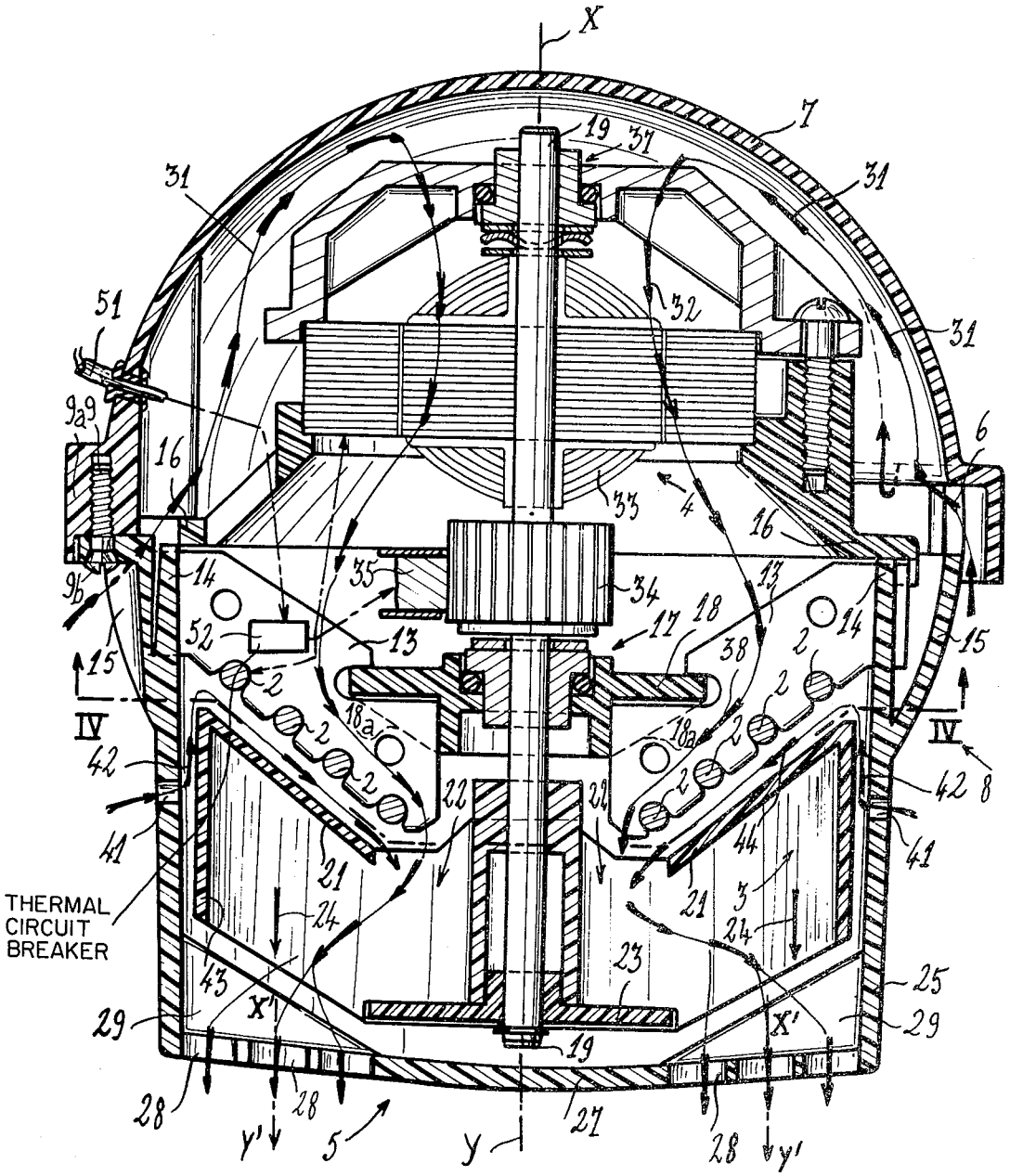
FIG. 3 is an axial sectional view of the hair-dryer of FIG. 1, taken along line III—III of FIG. 2.

In the embodiment which is illustrated in FIGS. 1 to 4, the hand-operated electric hair-dryer comprises a body 1 forming a casing and containing a resistance-type heating element 2 associated with an impeller 3 which is driven by an electric motor 4. An opening formed in the body 1 constitutes an ejection nozzle 5 for hot air.

The body 1 which is so designed that it may readily be grasped with one hand is of spherical shape (for example approximately 80 mm in diameter). The air-ejection nozzle 5 is directed radially along an axis X–Y of the spherical body 1.

In accordance with the invention (as shown in FIG. 3), the electric motor 4, the heating element 2 and the impeller 3 are disposed in that order along the axis X–Y of the air-ejection nozzle 5. The impeller 3 is housed within a projecting cylindrical portion 25 adapted to carry the ejection nozzle 5 in the immediate vicinity of said nozzle. In the equatorial zone of the body with respect to the axis X–Y, the hair-dryer is provided with a series of contiguous air admission openings 6. The openings 6 are disposed between the adjacent lips of a hemispherical cap 7 constituting the bottom portion of the casing 1 and a cap 8 which carries the ejection nozzle 5, said nozzle being secured to the hemispherical cap 8 by means of coupling screws 9.

An edge beading 12 of the hemispherical cap 7 which is disposed in the aforementioned equatorial zone of the body 1 constitutes a continuous projection for protecting the air inlets 6. By way of example, the beading 12 has an external diameter of the order of 100 mm and projects to a distance of approximately 10 mm from the spherical surface of the body 1. The two caps 7, 8 are formed of molded plastic material, for example, and are each provided in the vicinity of their connecting edges with bosses **9*a* and lugs 9*b* which are adapted to receive the coupling screws 9 (as shown in FIGS. 2 and 3**).

The resistance-type heating element 2 (shown in FIGS. 3 and 4) is disposed on a frusto-pyramidal surface having regular faces and an axis X–Y. The heating element 2 is constituted by a wire twisted in a helix with slightly spaced turns and passed over a core of asbestos fibers. The heating element 2 is mounted under slight elastic tension within notches of six oblique supports 13 which are disposed radially along the edges of the pyramid frustum aforesaid.

The supports 13 are strips of ceramic material each oriented along a plane which passes through the axis X–Y; one end of each radial support 13 is engaged in a slot of a cylindrical rim 14 of the cap 8. Said rim is provided externally with a spherical portion 15 which is joined to the general profile of the hemispherical cap 8. The spherical portion 15 thus surrounds the tubular portion 14 which retains the ends of the supports 13 and masks these latter. Internal bosses 16 of the rim of the cap 7 are provided with projections for accurate centering and positioning of the ends of the supports 13, especially in order to facilitate the assembly of the hair-dryer. The bosses 16 thus serve to lock the supports 13 onto the body 1 under the clamping action of the assembly screws 9.

A bearing 17 of the motor 4 is secured to the radial supports 13 by means of a head-piece 18 which forms a bearing retention cup. The edge of the head-piece 18 accordingly forms a circular flange which is engaged in a notch of each support 13 at the end remote from the point at which the support is secured to the body 1. One edge of the support 13 which is directed along the axis X–Y is applied against the central portion of the head-piece 18 within suitable slots. The strength of the assembly described above is further improved by bonding with resin which is resistant to the temperatures expected at this point. In the portion 18*a* which is located opposite to the heating element 2, the head-piece 18 has a substantially conical profile which is parallel to the surface of the heating element 2.

The shaft 19 of the motor 4 is aligned on the geometrical axis X–Y of the body 1 and carries the impeller 3. On the side remote from the air-ejection nozzle 5, the impeller 3 is provided with an upstream cheek 21 having a conical profile which is substantially parallel to the surface of the heating element 2 and disposed opposite to said element. The upstream cheek 21 has a suction opening 22 in that portion which is adjacent to the impeller shaft 19.

On the side nearest the air-ejection nozzle 5, the impeller 3 has a downstream cheek 23 which is provided with peripheral recesses so as to constitute openings 24 which are partitioned by the internal impeller blades for the ejection of hot air. The central portion of the downstream cheek 23 constitutes a solid disc which is centered on the axis X–Y.

The ejection nozzle 5 (shown in FIG. 3) of circular cross-section is carried by a projecting cylindrical portion 25 of the cap 8. The central portion of the ejection nozzle 5 which is centered on the axis X–Y constitutes a solid plate 27 corresponding substantially to the central disc of the downstream cheek 23 of the impeller 3. Hot-air ejection holes 28 having axes X′–Y′ each oriented parallel to the axis X–Y are disposed around the plate 27 and extend over a zone which corresponds substantially to the ejection openings 24 of the impeller 3. Flat triangular partitions 29 which are disposed parallel to the axis X–Y and distributed radially around said axis in the internal portion of the nozzle 5 delimit separate sectors for the flow of hot air which arrives at the ejection holes 28.

As shown in FIG. 3, the hair-dryer is provided with a first series of internal air passages which communicate with the equatorial air-admission openings 6 and first comprise passages 31 along the internal wall of the hemispherical cap 7; then passages 32 in the vicinity of the windings 33, of the commutator 34, of the brushes 35 and of the bearings 17, 37 of the motor 4; and finally passages 38 between the face of the heating element 2 and the conical portion 18*a* of the head-piece 18. The passages 38 terminate in the suction opening 22 of the impeller 3.

The hair-dryer is provided on the projecting cylindrical portion 25 which carries the ejection nozzle 5 (as shown in FIGS. 1 and 3) with openings which constitute additional air inlets 41. A second series of internal air passages in communication with said inlets 41 comprises successively an annular passage 42 between the peripheral side-wall 43 of the impeller 3 and the cylindrical portion 14/25 of the cap 8; provision is then made within each of the sectors partitioned by the radial supports 13 for a passage 44 between the upstream cheek 21 of the impeller 3 and the face of the heating element 2 located opposite to the cheek 21. The passages 44 terminate in the suction opening 22 of the impeller 3.

Electric current is supplied to the heating element 2 and to the motor 4 through a flexible lead 51 by means of an operating switch (not shown) which is rigidly fixed on the body 1 and by means of a safety circuit-breaker 52 of the bimetallic strip type (as shown in FIG. 3), the function of which is explained hereinafter.

In the embodiment which has just been described, the heating element 2 has, for example, a power rating of 250 watts and the motor 4 has a power rating of approximately 70 watts at a normal running speed of 12,000 revolutions per minute. The diameter of the impeller 3 is approximately 60 mm.

The operation of the hair-dryer which has just been described will now be explained.

The spherical shape of the body 1 and the diameter of this latter which is in proportion to the usual size of users' hands make it very easy to hold with one hand, the ends of the outspread fingers being intended to retain the equatorial beading 12. Handling and orientation of the hair-dryer are thus very convenient since the direction of the fingers of the hand which holds the appliance coincides with the axis X–Y of the ejection nozzle. Irrespective of the position of his or her forearm, the user can thus orient the hair-dryer in a virtually instinctive manner, especially in the back region of the head.

The arrangement of the motor 4, of the heating element 2 and of the impeller 3 in that order along the axis X–Y of the nozzle 5 (as shown in FIG. 3) permits a particularly compact arrangement of these components within the spherical space of the body 1. As will become apparent hereinafter, this arrangement also makes it possible to ensure efficient cooling of the cap 7, of the impeller 3 and of the projecting spherical portion 25 which carries the nozzle 5. These components can thus be made of plastic material and a hair-dryer of very light weight can accordingly be obtained.

When the hair-dryer is turned-on, the impeller 3 which is driven by the motor 4 sucks air through its opening 22. The air penetrates into the body 1 through the equatorial openings 6 which are protected by the edge beading 12 and through the additional inlets 41 of the projecting cylindrical portion 25. The locations of these various openings and the projecting portion constituted by the beading 12 prevent the user's fingers from closing-off these openings even partially, with the result that there is no likelihood of any defects in air circulation or of internal overheating.

The circulation of fresh air within the passages 31 (as shown in FIG. 3) against the internal wall of the hemispherical cap 7 prevents excessive heating of said cap in contact with the user's hand. The circulation of air within the passages 32, 33, 38 has the effect of cooling the components of the motor 4 and of supplying air to the heating element 2. Complementary circulation through the additional inlets 41 and the passages 42, 44 ensures cooling of the impeller 3, especially on its peripheral side-wall 43 and on its upstream cheek 21 so as to compensate for the effect of radiation of the heating element 2 and of the circulation of air which is heated by said element. The complementary circulation aforesaid thus ensures cooling of the cap 8.

The caps 7 and 8 as well as the impeller 3 can accordingly be fabricated from molded plastic material without encountering any difficulties in regard to endurance since these parts are cooled during the operation of the hair-dryer. The form of construction described above also permits economical, lightweight and accurate manufacture as well as having a very attractive appearance.

The radial arrangement of the supports 13 of the heating element 2 (shown in FIGS. 3 and 4) constitutes immediately upstream of the suction opening 22 of the impeller 3 a gridwork of directing vanes which partitions and stabilizes the flow of air in the vicinity of the heating element 2. This particular feature is advantageous in regard to both efficiency and regularity of heating of the air and in regard to the efficiency of the impeller. The triangular partitions 29 perform a similar flow-directing function on the downstream side of the impeller.

The central disc 23 of the impeller 3 and the corresponding solid portion 27 of the ejection nozzle serve to prevent the axial backflow which is liable to form outside the ejection nozzle 5 when the ejection openings 24 of the impeller and the corresponding holes 28 of the nozzle 5 are not located at a sufficient distance from the axis X–Y. This accordingly prevents various disordered movements of the hair to be dried which might even cause hair to be sucked into the unprotected axial zone.

In the event of internal overheating of the hair-dryer, especially as a result of accidental blockage of the holes 28 of the ejection nozzle, the thermal circuit-breaker 52 cuts-off the supply of the heating element 2 and of the motor 4 and maintains this interruption of the current supply as long as the internal temperature of the hair-dryer has not returned to an acceptable value. This value is chosen in particular so as to ensure protection of parts made of plastic material and especially in order to protect the upstream cheek 21 of the impeller in the immediate proximity of the heating element 2.

As will be readily understood, the invention is not limited to the form of construction which has just been described by way of example and many alternative forms may be contemplated without thereby departing either from the scope or the spirit of the invention.

We claim:

1. A hand-operated electric hair dryer comprising a casing which contains a resistance-type heating element associated with an impeller driven by an electric motor, and an air-ejection nozzle directed radially outwardly with respect to said casing, said casing comprising a first substantially hemispherical cap joined to a second substantially hemispherical cap which carries the ejection nozzle, both joined caps of the casing thus forming a substantially spherical body, at least one air-admission opening between joined edges of said caps, and a projecting beading on the edge of one of said caps arranged substantially around said spherical body and protecting said opening, said impeller being arranged for air to be drawn first into the casing through the air-admission opening, then to pass in heating contact with the heating element, and finally to pass through the impeller to be discharged from the casing through the nozzle, and the dimensions of both caps and of said projecting beading being such as to permit an easy holding of said first hemispherical cap against the palm of the hand with the projecting beading being grasped by the ends of the outspread fingers of said hand, said heating element and said air ejection nozzle having a common axis substantially coincident with the axis of revolution of the impeller, said heating element being secured within the casing by means of radial supports disposed radially with respect to said axis of revolution, each of said radial supports being fixed at one end within recesses of the cap which carries the ejection nozzle.

2. A hair-dryer as defined in claim 1, wherein said radial supports are locked in position by clamping between the first hemispherical cap and the cap which carries the ejection nozzle.

3. A hair-dryer as defined in claim 1, wherein at least one bearing of the motor is secured to the radial supports of the heating element.

4. A hair-dryer as defined in claim 3, wherein the motor bearing is secured in rigidly fixed relation to the radial supports by securing means comprising a head-piece forming a bearing retention cup, an edge of said head-piece being engaged in locking recesses disposed on the radial supports at the ends remote from the points of attachment of said supports to the cap which carries the ejection nozzle.

5. A hair-dryer as defined in claim 4, wherein the head-piece for securing the bearing to the radial supports is provided opposite to the heating element with a profile which is substantially parallel to the surface of said heating element.

6. A hand-operated electric hair dryer comprising a casing which contains a resistance-type heating element associated with an impeller driven by an electric motor, and an air-ejection nozzle directed radially outwardly with respect to said casing, said casing comprising a first substantially hemispherical cap joined to a second substantially hemispherical cap which carries the ejection nozzle, both joined caps of the casing thus forming a substantially spherical body, at least one air-admission opening between joined edges of said caps, and a projecting beading on the edge of one of said caps arranged substantially around said spherical body and protecting said opening, said impeller being arranged for air to be drawn first into the casing through the air-admission opening, then to pass in heating contact with the heating element, and finally to pass through the impeller to be discharged from the casing through the nozzle, and the dimensions of both caps and of said projecting beading being such as to permit an easy holding of said first hemispherical cap against the palm of the hand with the projecting beading being grasped by the ends of the outspread fingers of said hand, the impeller on its side nearest to the ejection nozzle, comprising a downstream cheek having openings at its periphery for the ejection of hot air, said downstream cheek comprising in its central portion a solid disc centered on the axis of the impeller, the ejection nozzle having a substantially circular transverse cross-section with peripheral hot air ejection openings and a solid central portion substantially corresponding to the openings and to the central disc of said impeller cheek, respectively.

7. A hand-operated electric hair dryer comprising a casing which contains a resistance-type heating element associated with an impeller driven by an electric motor, and an air-ejection nozzle directed radially outwardly with respect to said casing, said casing comprising a first substantially hemispherical cap joined to a second substantially hemispherical cap which carries the ejection nozzle, both joined caps of the casing thus forming a substantially spherical body, at least one air-admission opening between joined edges of said caps, and a projecting beading on the edge of one of said caps arranged substantially around said spherical body and protecting said opening, said impeller being arranged for air to be drawn first into the casing through the air-admission opening, then to pass in heating contact with the heating element, and finally to pass through the impeller to be discharged from the casing through the nozzle, and the dimensions of both caps and of said projecting beading being such as to permit an easy holding of said first hemispherical cap against the palm of the hand with the projecting beading being grasped by the ends of the outspread fingers of said hand, said impeller having an axial inlet, said heating element being disposed immediately upstream of the axial inlet of the impeller, at least an additional air inlet being provided on the cap bearing the ejection nozzle, a second series of air passages in communication with the additional air inlet, said second series of passages being disposed between the upstream part of the impeller and the heating element, and terminating in the said axial inlet of the impeller.

* * * * *